US006318601B1

(12) United States Patent
Burnham

(10) Patent No.: US 6,318,601 B1
(45) Date of Patent: Nov. 20, 2001

(54) PERSONAL SPRAY DISPENSING DEVICE

(76) Inventor: Donald Burnham, 6 Horseshoe Dr., Derry, NH (US) 03038

( * ) Notice: Subject to any disclaimer, the term of this patent is extended or adjusted under 35 U.S.C. 154(b) by 0 days.

(21) Appl. No.: 09/758,561

(22) Filed: Jan. 11, 2001

(51) Int. Cl.[7] ..... B67D 5/06
(52) U.S. Cl. ..... 222/183; 222/321.9; 222/402.1
(58) Field of Search ..... 222/183, 402.1, 222/321.9, 175, 402.2

(56) References Cited

U.S. PATENT DOCUMENTS 3,964,647 6/1976 Dearling .
5,184,761 2/1993 Lee .
5,224,630 * 7/1993 Pope et al. ..... 222/183
5,862,960 2/1999 Miller .

* cited by examiner

*Primary Examiner*—Philippe Derakshani
(74) *Attorney, Agent, or Firm*—Lambert & Associates, PLLC; Gary E. Lambert; Edward Timmer

(57) ABSTRACT

A personal spray dispensing system designed for personalized use. The system may be actuated by a pump or by an aerosol propellant system. The dispensing system may be employed to disseminate a deodorizing, antibacterial or air freshening agent. Each dispensing system is specifically designed to be small enough to carry on the person of the user or in a brief case or pocketbook.

17 Claims, 4 Drawing Sheets

PERSONAL SPRAY DISPENSING DEVICE

FIELD OF THE INVENTION

This invention relates generally to the field of spray dispensing and in particular a personal spray dispensing device.

BACKGROUND

Various types of spray dispensing systems are in existence today. One manner in which spray dispensing systems are utilized is for scattering deodorizing, sanitizing or air freshening agents into the atmosphere in confined spaces. Many of these dispensing systems are employed in wall-mounted mechanisms, set to automatically discharge by a timing mechanism. The more common dispensing systems are contained in large, hand held canisters, which are stored on shelves and accessed when needed.

Whether these dispensing systems are handheld or wall mounted, these systems are obviously not designed to be transported on the person or in a travel bag of an individual. Occasions arise when a person may need a deodorizing, antibacterial or air freshening spray and often times none such spray is made available to the person by the facility in which the person is presently located. Such facilities may include a public restroom, a place of employment, a hotel, a vehicle, an ocean going vessel or a cruise ship. Many times these spaces are cramped and/or dark and thus even a small sized deodorizer in a personal carry bag would be hard to identify.

Thus, the need for a portable, personal, and easily identifiable dispensing system is felt. The present invention meets this need by providing such a personal deodorizing, antibacterial or air freshening system in an aerosol or pump.

SUMMARY OF THE INVENTION.

The instant invention reveals a petite, uniquely shaped, spray dispensing system, which is conveniently sized for carrying on a person or in a handbag, purse, etc. Due to its unique shape, this system is easily identifiable to the touch, as compared to any other objects carried on one's person. This quality enables a user to reach into a pocket, purse or suitcase in confined quarters or areas void of light and easily discover the device. The personal spray dispensing device may be employed to provide the user with a personal deodorizing, antibacterial or air freshening system, which is easily disposable. Due to the parameters involved with the design of this system, a minimal amount of deodorizing agent may be dispensed, and thus, an inexpensive system may be achieved. The personal dispensing system may be sold in individual units, in multi unit packs or administered with a set of toiletries designed as a travel package.

DETAILED DESCRIPTION OF THE PREFERRED EMBODIMENT

Figure 1:
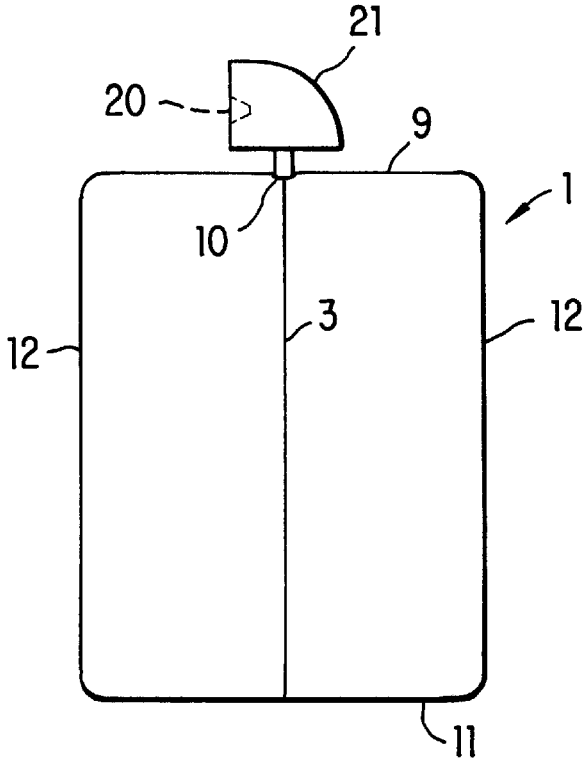
FIG. 1 is an elevational view showing the personal spray dispensing system in the aerosol configuration with a flat side view.
Figure 2:
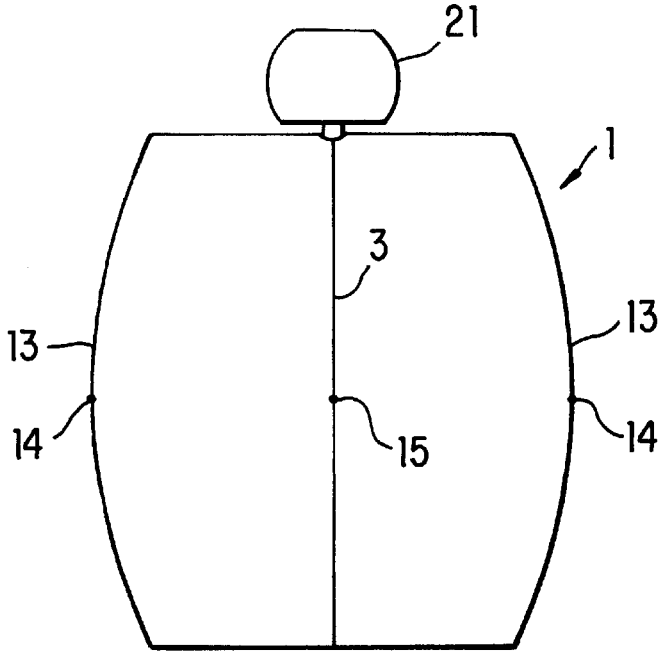
FIG. 2 is an elevational view showing the personal spray dispensing system in the aerosol configuration with an arcuate side view.
Figure 3:
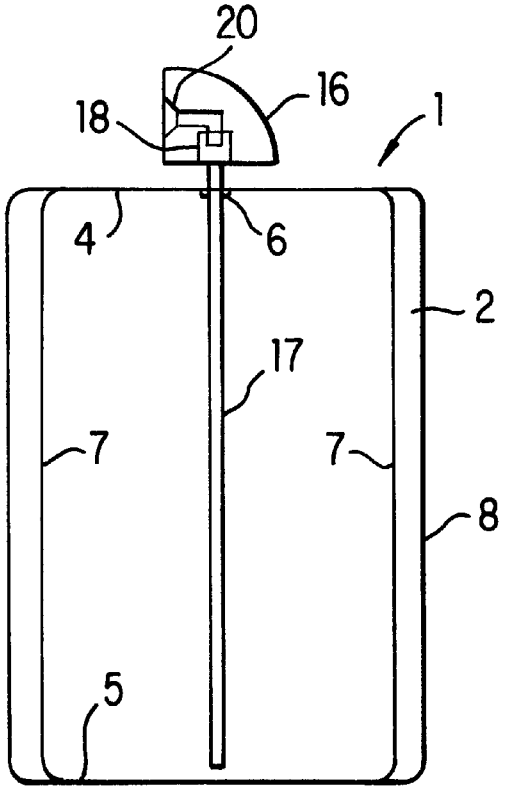
FIG. 3 is an exploded elevational view of the aerosol version of the invention, showing the inner containment chamber and the fluid discharge system including the pressure control device.
Figure 4:
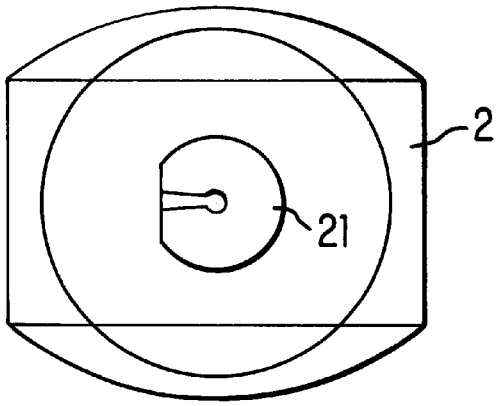
FIG. 4 is a top plan view showing inner containment chamber and the actuation button.

With reference to FIGS. 1–5, in one preferred embodiment, the personal spray dispensing device 1 is comprised of an inner containment chamber 2, being cylindrical in shape and disposed radially about a longitudinally oriented axis 3. The inner containment chamber 2 may be comprised of a top portion 4, which is circular in shape and radially disposed about said longitudinally oriented axis and located in a plane perpendicular to this longitudinally oriented axis. There is an aperture 6 in the top portion 4 of the inner containment chamber 2, this aperture being disposed radially about the longitudinally oriented axis 3. The inner containment chamber may have a base 5, which is circular in shape, radially disposed about said longitudinally oriented axis and also located in a plane perpendicular to said longitudinally oriented axis. The side portions 7 of said inner containment chamber are cylindrically disposed about the longitudinally oriented axis. The inner containment chamber is adapted to contain a pressurized fluid. The inner containment chamber may also be comprised of a cylindrically shaped vessel containing an aperture, adapted to contain pressurized fluid which is not constricted to the radial fit around the longitudinal axis described above.

An outer casing 8, adapted to encapsulate said inner containment chamber 2, encloses the contents of the system. The outer casing 8 is comprised of a top portion 9 with an aperture 10 contained within, a base 11, a set of two opposing side elements of a flat construction 12 and a set of two arcuate shaped opposing side elements 13. The midpoint 14 of said set of two arcuate shaped side elements 13 corresponds laterally with the midpoint 15 in said longitudinal axis 3. In another preferred embodiment, the inner containment chamber and outer casing may share a top portion and a bottom portion.

The personal spray device is further comprised of a fluid discharge system 16 consisting of a cylindrical member 17 having an upper and lower end, said lower end of said cylindrical member 17 in fluid communication with said pressurized fluid. The lower end of the cylindrical member 17 is positioned proximally to the base 11 of the inner containment chamber 2 and extends longitudinally from said inner containment chamber 2 through said aperture 6 in said top portion 4 of said inner containment chamber 2. The cylindrical member next passes into the outer casing 8 and out to the pressure control device 18 through the aperture 10 in the top portion of the outer casing 8.

The pressure control device 18 contains at least one orifice 19, attached to the upper end of said cylindrical member 17. In the pressurized fluid embodiment, the pressure control device 18 diverts the flow of the fluid from the cylindrical member 17 through a nozzle 20 in direct communication with the flow path of the pressure control device. The nozzle 20 imparts upon the exiting fluid a velocity, which allows the fluid to retain fine mist properties as well to travel a longer distance through the air to be affected.

Figure 5:
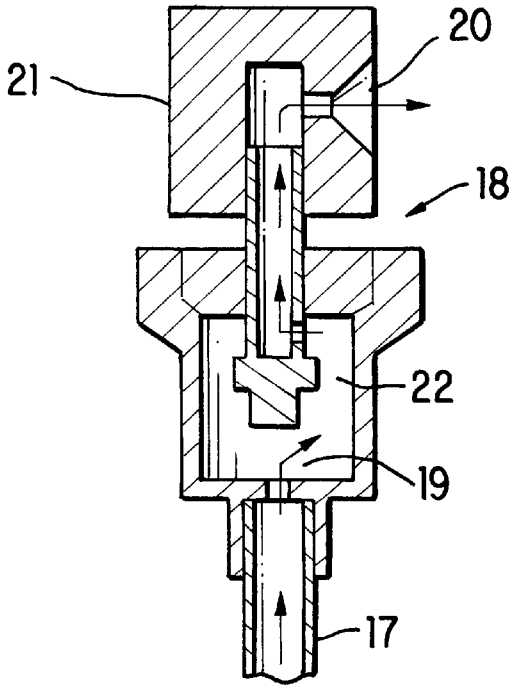
FIG. 5 is an exploded view of the pressure control device and fluid discharge system in the metered spray, aerosol embodiment.

The flow path of the pressure control device 18 is aligned substantially perpendicular to that of said cylindrical member 17 in order to channel the release of said pressurized fluid through the nozzle apparatus 20 and route the flow of pressurized fluid away from the user and into the atmosphere. FIG. 5 gives an exploded view of the elements of the pressure control device and fluid discharge system.

In one embodiment, the personal spray dispensing device can act as a personal deodorizing, antibacterial or air freshening system which can be carried on the person, in a travel bag or in a pocketbook. In this form the longitudinal distance from said base 11 of said outer casing 8 to said top of said outer containment chamber can be three (3.0) inches or less. Also, in this configuration, the distance between said midpoints of said set of two arcuate shaped opposing sides can be one (1) inch or less. The distance between said set of two opposing side elements of a flat construction, of said outer casing is designed to be greater than or equal to said distance between said midpoints of said set of two arcuate shaped opposing sides of said outer casing. The distance between said set of two opposing side elements of a flat construction can be one inch or less. Thus, due to its small size, the personal deodorizing system is highly suitable as a portable and disposable air freshener.

In another embodiment, the personal deodorizing system is designed so that the amount of pressurized fluid released upon an actuation of the pressure control device 18 is a constant, metered amount or a non-metered amount, which is controlled by the user. In the aerosol form, the total amount of pressurized fluid contained in the inner containment chamber 2 can be kept to a controlled level as to allow a minimal amount of actuations per unit. In creating a pressurized fluid mixture to be released from the personal deodorizing system, a mixture of a concentrate of the specific deodorizing agent, combined with a gaseous propellant, or mixture of different propellants, may be utilized. By regulating the amount of propellant added to the pressurized fluid mixture, a desired amount of metered spray releases may be attained. This feature can work to keep the personal deodorizing system inexpensive and disposable.

Although different numbers of total actuations may be preset by the controlled use of propellant as stated above, a minimal number of discharges is preferred, due to the small size of the units. In one embodiment, the number of total actuations per unit of the personal deodorizing system may be ten metered discharges. In another embodiment, number of total actuation per unit of the personal deodorizing system may be fifteen metered discharges. In other embodiments, the system may be designed to allow fewer than fifteen and even fewer than ten discharges.

The aerosol embodiment of the personal spray dispensing devise may contain an amount of pressurized fluid greater than or equal to one eighth of an ounce and less than or equal to three quarters of an ounce.

The personal spray dispensing system, in the metered spray release embodiment, as depicted in FIG. 5, operates like common aerosol systems known in the art. The actuation button 21 is simply depressed and the valve 22 of the pressure control device 18 is thus placed in the open position. The fluid flows through the orifice 19 or through a plurality of orifices and then through the opened valve 22 and out the nozzle 20 to the atmosphere.

Figure 6:
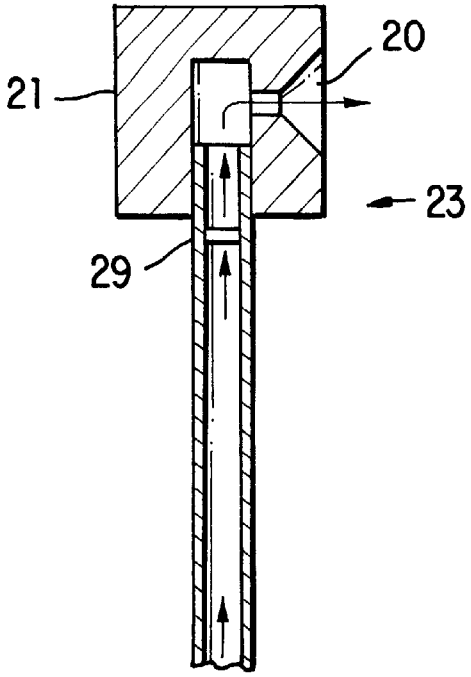
FIG. 6 is an exploded view of the pressure control device and fluid discharge system in the non-metered spray, aerosol embodiment.

In the non-metered spray embodiment, as depicted in FIG. 6, as the button 21 is depressed, a constant flow of spray is released through the opened valve 29 and dip tube system 23, to the nozzle 20 for acceleration to the atmosphere. This configuration allows the user to release as much spray as needed in only one actuation.

In still another embodiment, the actuation system will comprise a non-aerosol pump. In the non-aerosol, pump configuration, there will be no separate containment chambers. The entire inside of the singular container may be filled with fluid and the outer portion maybe made of clear or colored plastic. The contents of the singular chamber are not held under pressure. In such a system, no propellant will be utilized and the single container will hold only the deodorizing, antibacterial or air freshening liquid.

In the non-aerosol configuration, a depressable actuation button may be employed to impress upon a piston, spring and valve mechanism contained in a cylindrical inner containment chamber. The reciprocating motion of the piston, spring and valve mechanism forces down on the fluid in the inner containment chamber and forces fluid through a flow path comprising an annular orifice arrangement with a flowpath in fluid connection with the release valve attached. Once an amount of fluid, displaced from the inner containment chamber by the force of the travel of the piston mechanism, is allowed to pass through the valve, the fluid is channeled through a nozzle and given an exit velocity.

Figure 7:
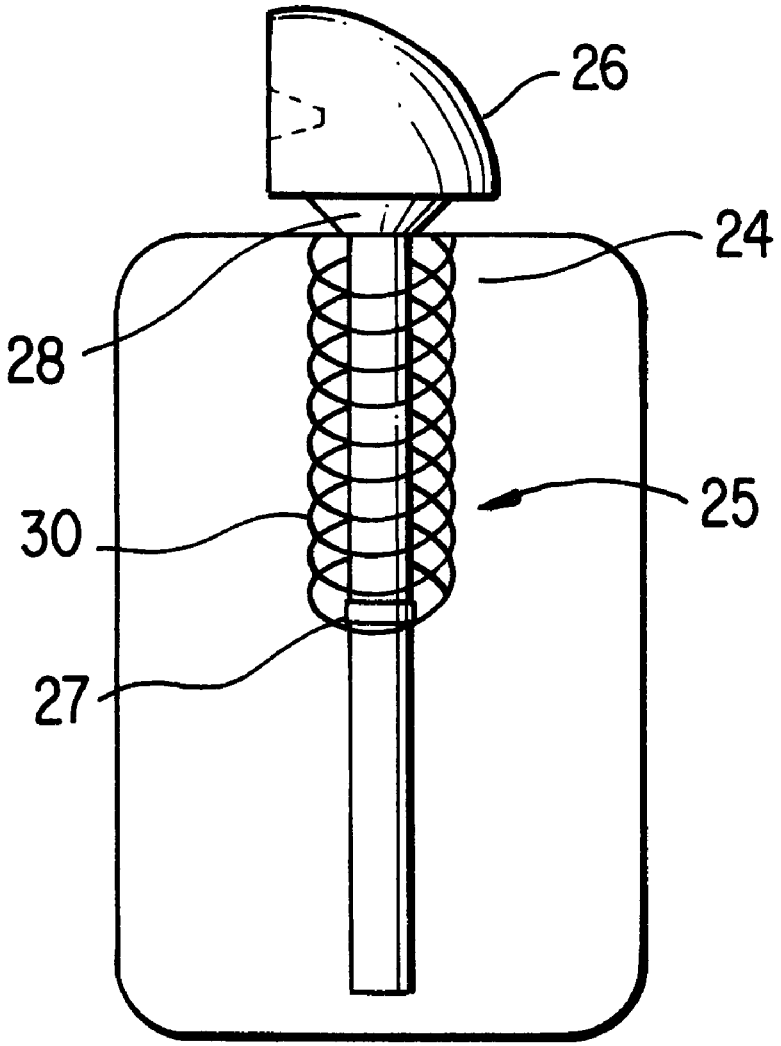
FIG. 7 is an exploded view of the non-aerosol, pump system, depicting the complete containment, pumping, flow and discharge systems.

In the non-aerosol fluid discharge system, as depicted in FIG. 7, the pumping mechanism 24 operates like others known in the art and comprises a piston, spring and valve assembly 25, in connection with a valve and dip tube assembly 27, such that when the actuation piston 26 is depressed, it travels downward compressing the contained fluid. The piston 26, forces the valve closed and the pressure forces the fluid out the nozzle. Upon release of the piston, the spring pushes the piston 26 back up while the valve below opens and draws new fluid into the reservoir 30, ready for compression and spraying with the next depression of the piston 26. The valve and dip tube assembly 27 exist in fluid communication with the piston 26, and thus when the piston 26 is depressed, the fluid evacuates said reservoir through orifices 28 located in the piston 25 and out to the atmosphere.

The discharge system may be designed such that a fluid enclosed in the containment chamber is expelled upon a complete travel of said piston. Due to the unusual shape and small size of the personal dispensing system, a unit will be easily recognized by the touch, when mixed in with other items in a travel bag, pocket or pocketbook. Also, due to the small discharge capacity of the personal dispensing system, the system can be easily manufactured and sold inexpensively as a disposable unit.

The above-preferred embodiments considered, it will be observed that numerous different configurations and alternatives may be achieved with out straying from the scope of the original invention. With this in mind, it is stated that no limitation with respect to the specific apparatus illustrated herein is intended or should be inferred. It is, of course, intended to cover by the appended claims all such modifications as are covered by the scope of the claims.

I claim:

1. A personal spray dispensing system comprising:

a cylindrically shaped inner containment chamber adapted to contain a pressurized fluid, said cylindrically shaped inner containment chamber containing a top portion with an aperture in said top portion, an outer casing adapted to encapsulate said inner containment chamber, said outer casing comprising a top with an aperature disposed radially about said longitudinally oriented axis, a base, a set of two opposing side elements of a flat construction and a set of two arcuate shaped opposing side elements, a mid-point located in each of said set of two said arcuate shaped side elements corresponding laterally with a midpoint located in said longitudinal axis, a fluid discharge system comprising a cylindrical member having an upper and lower end, said lower end of said cylindrical member in fluid communication with said pressurized fluid, said lower end of said cylindrical member positioned closely to said base of said inner containment chamber and extending longitudinally from said inner containment chamber through said aperture in said top of said inner containment chamber and through said aperture in said outer casing, a pressure control device, in communication with and aligned substantially perpendicular to said upper end of said cylindrical member, said pressure control device containing a plurality of orifices disposed to channel the flow of said pressurized fluid to a nozzle apparatus for release of said pressurized fluid to an atmospheric medium.

2. The spray dispensing device of claim 1, wherein said inner containment chamber is disposed radially about said longitudinally oriented axis, said inner containment chamber consisting of a top portion, circular in shape and radially disposed about said longitudinally oriented axis, said top portion located in a plane perpendicular to said longitudinally oriented axis and containing an aperture disposed radially about said longitudinally oriented axis; a base circular in shape, radially disposed about said longitudinally oriented axis and located in a plane perpendicular to said longitudinally oriented axis, and side portions disposed cylindrically about said longitudinally oriented axis; said inner containment chamber adapted to contain a pressurized fluid.

3. The spray dispensing device of claim 1, wherein a longitudinal distance from said base of said outer casing to said top of said outer casing is three inches or less.

4. The spray dispensing device of claim 1, wherein a distance between said midpoints of said set of two arcuate shaped opposing sides of said outer casing is one inch or less.

5. The spray dispensing device of claim 1, wherein a distance between said set of two opposing side elements of a flat construction, of said outer casing is greater than or equal to said distance between said midpoints of said set of two arcuate shaped opposing sides of said outer casing.

6. The spray dispensing device of claim 1, wherein a distance between said set of two opposing side elements of a flat construction is one and one-half inch or less.

7. The spray dispensing device of claim 1, wherein an amount of said pressurized fluid released upon an actuation of said pressure control device is constant.

8. The spray dispensing device of claim 1, wherein the amount of fluid contained within said spray dispensing device is greater than one eighth of an ounce.

9. The spray dispensing device of claim 1, wherein an amount of fluid contained is one and one half ounces or less.

10. The spray dispensing device of claim 1, wherein said spray dispensing device releases a minimum number of discharges, said minimum number of discharges to be limited by an amount of a propellant chemical contained in said dispenser.

11. The spray dispensing device of claim 1, wherein said spray dispensing device releases a minimum number of discharges, said minimum number of discharges to be limited by an amount of pressurized fluid and a volume of fluid contained in said dispenser.

12. The spray dispensing device of claim 1, wherein said spray dispensing device releases a minimum number of discharges, said minimum number of discharges to be limited by said volume of fluid contained in said dispenser.

13. The spray dispensing device of claim 8, wherein said amount of said propellant chemical contained in said pressurized gas allows for said spray dispensing device to release ten or less metered discharges.

14. The spray dispensing device of claim 8, wherein an amount of a propellant chemical contained in said pressurized gas allows for the said spray dispensing device to release fifteen or less metered discharges.

15. A personal spray dispensing system comprising:

a cylindrically shaped inner containment chamber adapted to contain a fluid, said inner containment chamber containing a top portion with an aperture in said top portion, wherein said inner containment chamber is in complete contact with an outer casing adapted to encapsulate said inner containment chamber, said outer casing comprising a top with an aperature disposed radially about said longitudinally oriented axis, a base, a set of two opposing side elements of a flat construction and a set of two arcuate shaped opposing side elements, a midpoint located in each of said set of two said arcuate shaped side elements corresponding laterally with a midpoint located in said longitudinal axis, a fluid discharge system comprising:

an actuation piston disposed with a plurality of orifices, spring and valve assembly;

a valve and dip tube assembly;

a fluid reservoir;

wherein said valve and dip tube assembly is in fluid communication with said reservoir and said reservoir is in communication with said piston, spring and valve assembly, such that upon depression of said actuation piston, said valve is closed and fluid flows from said reservoir through said plurality of orifices to the atmosphere;

wherein said valve is opened when said piston is located in the non-depressed position.

16. The personal spray system of claim 15 wherein, a fluid enclosed in said containment chamber is expelled upon a complete travel of said piston.

17. The spray dispensing device of claim 16, wherein said spray dispensing device releases a minimum number of discharges, said minimum number of discharges to be limited by the volume of fluid contained in said dispenser.

* * * * *